US006056470A

United States Patent [19]

Nehashi et al.

[11] Patent Number: 6,056,470

[45] Date of Patent: May 2, 2000

[54] SIDE-PUSH TYPE OF CONTAINER

[75] Inventors: Hiroto Nehashi, Tokyo; Hiroaki Takahashi, Saitama, both of Japan

[73] Assignees: Ikeda Corporation, Tokyo; Win Trading Yugen Kaisha, Sohka, both of Japan

[21] Appl. No.: 09/135,750

[22] Filed: Aug. 18, 1998

[30] Foreign Application Priority Data

Jan. 20, 1998 [JP] Japan ..... 10-008434

[51] Int. Cl.[7] ..... A46B 11/04

[52] U.S. Cl. ..... 401/279; 401/176

[58] Field of Search ..... 401/279, 176, 401/150, 278, 268, 270, 149

[56] References Cited

U.S. PATENT DOCUMENTS

| | | | |
|---|---|---|---|
| 4,692,047 | 9/1987 | Endo | 401/150 X |
| 4,810,124 | 3/1989 | Krueckel et al. | 401/279 X |
| 4,883,204 | 11/1989 | Kay et al. | 401/279 X |
| 5,352,054 | 10/1994 | Lhuisset | 401/279 X |

FOREIGN PATENT DOCUMENTS

| | | | |
|---|---|---|---|
| WO93/24030 | 12/1993 | WIPO | 401/279 |

*Primary Examiner*—David J. Walczak

*Attorney, Agent, or Firm*—Arent Fox Kintner Plotkin & Kahn PLLC

[57] ABSTRACT

Disclosed is a side-push type of container appropriate for use for instance, in a cosmetic applicator, permitting application of a cosmetic liquid material such as varnish to selected parts of a human body such as nails without using both hands for holding the separate parts of the cosmetic applicator, simply by using a forefinger of the hand holding the applicator to feed a predetermined amount of cosmetic liquid material to the applicator tip. It comprises a hollow container body having a depressible push button on its side, an application member partly inserted into the hollow container to expose the remaining part therefrom, and a valve mechanism responsive to depression of the depressible push button for feeding the application member with a fixed amount of liquid material. With this arrangement a single push to the depressible push button causes a predetermined amount of liquid material to be fed to the application member, thereby permitting the liquid material to seep evenly in the application member every time the depressible push button is pushed.

7 Claims, 9 Drawing Sheets

SIDE-PUSH TYPE OF CONTAINER

BACKGROUND OF THE INVENTION

1. Field of the Invention

The present invention relates to a leak-tight container appropriate for use in containing a liquid cosmetic material such as varnish, and more particularly to a side-push type of container which permits a predetermined amount of liquid to be fed to its applicator simply by using the forefinger of the hand in which the container is held without using a selected finger of the other hand.

2. Description of Related Art

Japanese Utility Model 55-40085(B) shows one example of such a cosmetic applicator. Referring to FIG. 13, it comprises a varnish container body 10 having a hollow varnish-remover 11 fixed to the open end 10*a* of the container body 10, an application rod 12 to be inserted in the container body 10 through its throttled inlet 11*c*, and an elongated cap 13 having the application rod 12 fixed thereto. The hollow varnish-remover 11 has upper and lower collars 11*a* and 11*b* fixed therearound. The application rod 12 has an annular ridge-like projection 13*a* formed in the vicinity of the shank base and a circumferential concave portion 13*b* formed just below the annular ridge-like projection 13*a*. When the application rod 12 is inserted in the hollow varnish-remover 11 through the throttled inlet 11*c*, the cosmetic liquid material along the shank length of the applicator 12 inside of the hollow container 10 is removed so that an increased amount of cosmetic liquid material is removed and retained in the annular space between the shank surface of the applicator 12 and the inner wall of the hollow remover 11. Finally the amount of cosmetic liquid material thus removed from the shank surface of the applicator 12 is driven into the hollow container 10 by the annular ridge-like projection 13*a*, which works like a piston.

In the conventional cosmetic applicator the remaining amount of cosmetic liquid material on the application rod 12 can be advantageously removed to return to the container 10, thereby keeping the open end 10*a* of the container body 10 and the shank surface of the application rod 12 clean. The opening space of the remover 11, however, is so small that the application rod 12 cannot be put in the container body 10 with ease. However, the container body 10 is inconveniently held in one hand, and the application rod 12 is held in the other hand while applying varnish to nails. This makes it difficult for nails to be coated evenly with varnish.

SUMMARY OF THE INVENTION

In view of the above, one object of the present invention is to provide a side-push type of container appropriate for use in a cosmetic applicator that permits application of a cosmetic liquid material, such as varnish, to selected parts of a human body, such as nails, without having to use both hands for holding the separate parts of the cosmetic applicator, simply by using a forefinger of the hand holding the applicator to feed a predetermined amount of cosmetic liquid material to the applicator tip.

To attain this object, a side-push type of container according to the present invention comprises a hollow container body having a depressible push button on its side, an application member partly inserted into the hollow container to expose the remaining part therefrom, and a valve mechanism responsive to depression of the depressible push button to provide the application member with a fixed amount of liquid material.

With this arrangement a single push of the depressible push button causes a predetermined amount of cosmetic liquid material to be fed to the application member, thereby permitting the cosmetic liquid material to flow evenly in the application member every time the depressible push button is pushed.

The valve mechanism may comprise a movable nozzle whose opposite ends are slidably fitted both in the application member and the hollow container, a piston connected to the rear end of the movable nozzle via an associated movable valve, energizing means, such as spring for biasing the piston in one direction, a cylinder spaced a predetermined distance apart from the piston in confronting relation while the energizing means remains dormant, thus delimiting a leak-tight valve compartment by the piston and cylinder, a reservoir storing a liquid material such as a cart ridge communicating with the leak-tight valve compartment, and a movable bottom piece fitted in the reservoir in leak-tight fashion.

Depression of the depressible push button will cause the movable nozzle to move against the energizing means, allowing the piston, which is closed with the movable valve, to move close to the cylinder to pressurize the valve compartment. Subsequent release of the depressible push button results in the piston returning to the initial position under the influence of the energizing means. Thus, the movable bottom plate is permitted to move forward under the influence of negative pressure within the valve compartment, thereby drawing a predetermined amount of cosmetic liquid material to the application member via the valve compartment, the piston opening, and the movable nozzle.

The movable bottom piece may have a concave circumference to be put in double-linear contact with the inner wall of the reservoir. This has the effect of holding cosmetic liquid material in leak-tight fashion, still assuring that the movable bottom piece can move smoothly.

The movable nozzle may have an axial channel formed along its central axis, a diverging or expanding end communicating with the axial channel, and an engagement lateral projection for engaging with at least one part of the depressible push button. The diverging or expanding end of the movable nozzle being movably fitted in the hollow container. The end of the movable nozzle opposite the diverging or expanding end being movably fitted within the application member.

With this arrangement, the movable nozzle can be put in correct position with ease and the application member and movable nozzle can be moved in a predetermined direction simply by pushing the depressible push button.

The reservoir, such as a cartridge, may be detachably attached to the hollow container body. This has the effect of facilitating the changing of cosmetic liquid material in terms of colors and kinds, and permits the side-push type container body to be used repeatedly without being thrown away after the cosmetic liquid material is exhausted.

These and other objects and advantages of the present invention will become more fully apparent from the following detail and description of first and second side-push type of containers according to the present invention, which are shown in the accompanying drawings.

DESCRIPTION OF THE PREFERRED EMBODIMENTS

Figure 1:
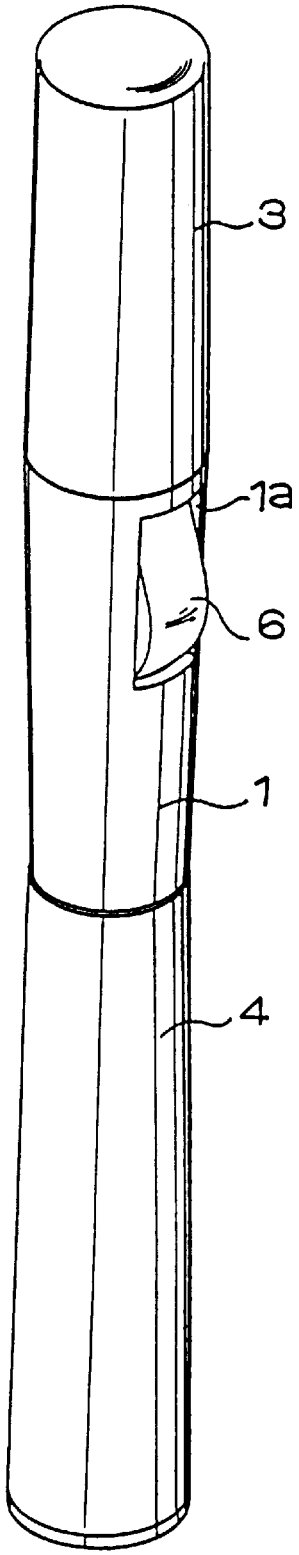
FIG. 1 is a perspective view of a side-push type of container according to a first embodiment of the present invention.

Referring to FIGS. 1 to 6, a side-push type of container A according to the first embodiment of the present invention comprises a hollow container body 1, an application member 2 projecting from the top of the container body 1, an elongated cap 3, a cartridge body 4 detachably attached to the rear end of the container body 1 and a valve mechanism 5 installed in the container body 1.

Figure 2:
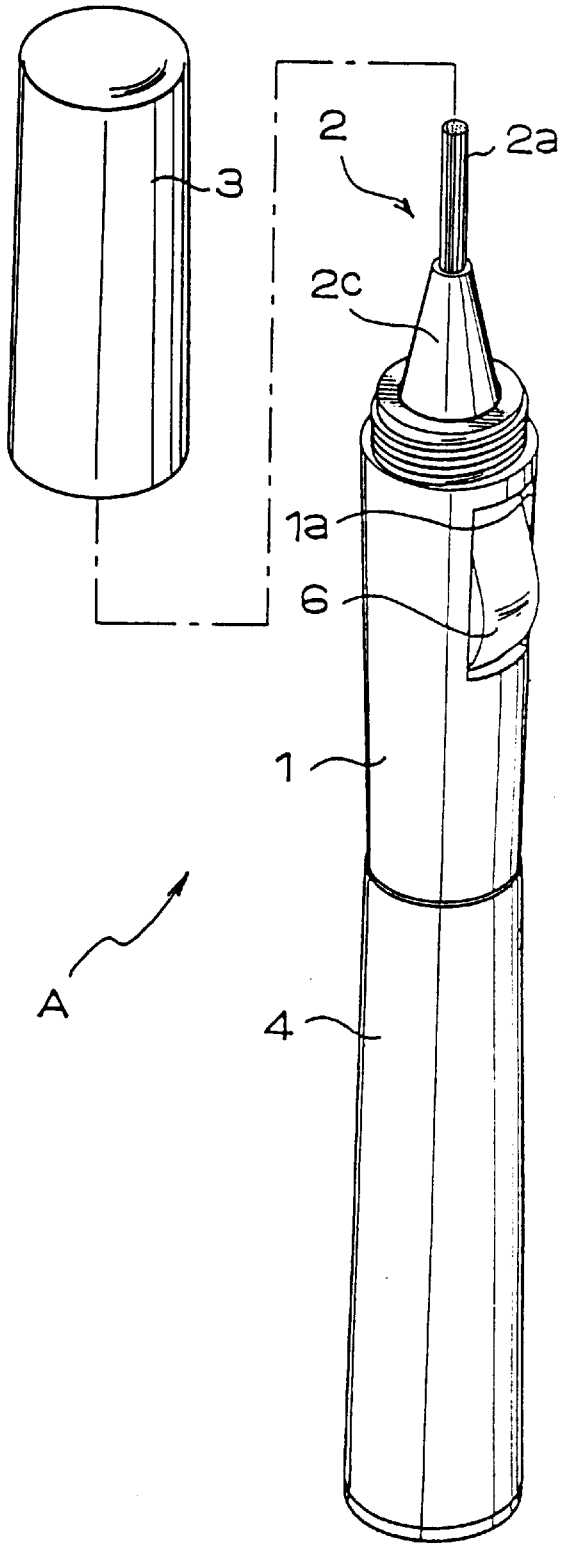
FIG. 2 is a perspective view of the side-push type of container with its cap removed from its container body.

The hollow container body 1 is made of a synthetic resin or any other appropriate material, and it has a slot 1*a* made on its side for accommodating movably a depressible button 6 (see FIGS. 1 and 2).

The hollow container body 1 has a sleeve 7 press-fitted therein. It has a slot 7*a* made on its side in registration with the slot 1*a* of the hollow container body 1, and its end projection has threads 7*b* formed therearound (see FIG. 3). The application member 2 is slidably fitted in the sleeve 7 (see FIGS. 4 and 5). It comprises a bundle of stiff hair, nylon, etc. 2*a*, a brush holder 2*b* and a nose piece 2*c* to be fitted on the brush holder 2*b* for converging the brush 2*a* (see FIG. 3). The brush holder 2*b* has an ejection nozzle $2b_1$ projecting from its top end and an enlarged end $2b_2$ formed at its rear end, and the ejection nozzle $2b_1$ is inserted in the brush 2*a*. The enlarged end $2b_2$ of the brush holder 2*b* has a movable nozzle 5*a* press-fitted in its recess (see FIGS. 4 and 5).

The elongated cylindrical cap 3 is made of a synthetic resin or any other appropriate material, and it has a coiled spring 3*a* and an inner conical cap 3*b* inserted therein. Thus, the inner conical cap 3*b* can be resiliently displaced upward in the elongated cap 3 (see FIGS. 4 and 5).

Figure 4:
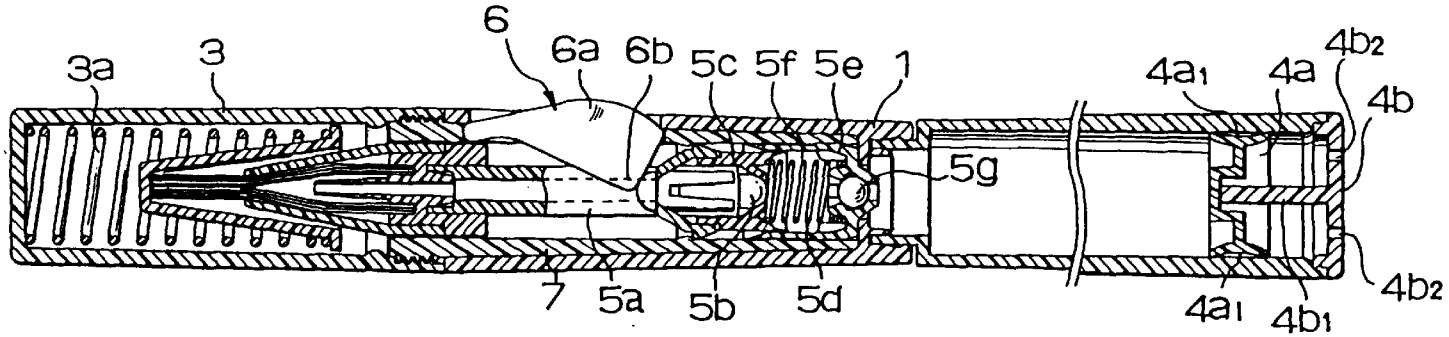
FIG. 4 is a longitudinal section of the side-push type of container.
Figure 5:
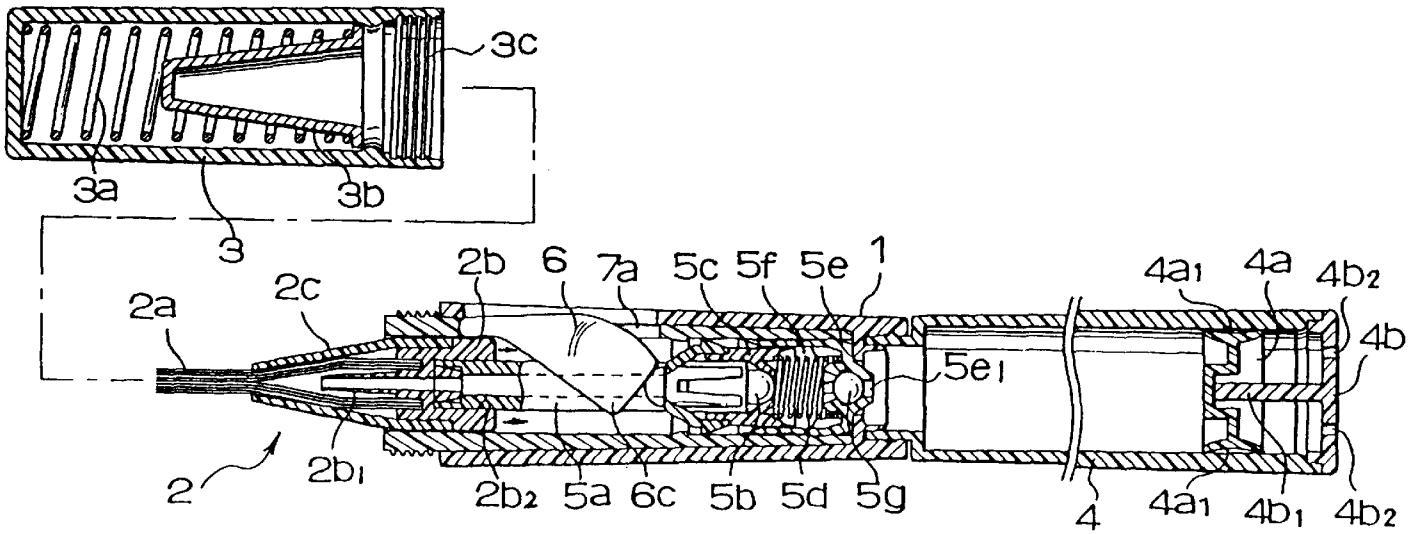
FIG. 5 is a longitudinal section of the side-push type of container with its cap removed from its container body.

When the elongated cylindrical cap 3 is put on the container body 1, and when the male-threaded end of the container body 1 is engaged with the female-tapped end of the elongated cylindrical cap 3 by rotating the container body 1 and the cylindrical elongated cap 3 relative to each other, the coiled spring 3*a* is yieldingly compressed to put the inner conical cap 3*b* on the nose piece 2*c*, thereby enclosing the application member 2 in air-tight fashion while the varnish applicator is not being used (see FIG. 4).

The cartridge body 4 has a movable bottom piece 4*a* slidably fitted in its bottom end. The movable bottom piece 4*a* is moved to drive the cosmetic liquid material when a negative pressure is produced in a valve compartment 5*f* as described below. As seen from FIGS. 4 and 5, the movable bottom piece 4*a* has a concave recess $4a_1$ formed on its circumference, thereby putting the movable bottom piece 4*a* in double-linear contact with the inner surface of the cartridge body 4.

Thus, the movable bottom piece 4*a* can be moved smoothly in the cartridge body 4, still preventing the cosmetic liquid material from leaking behind, and at the same time, preventing the surrounding air from invading in the cartridge body 4. As a matter of course, the material of which the movable bottom piece 4*a* and the cartridge body 4 are made is so selected that it may assure the fluid-tightness and the least possible friction between these parts.

The cartridge body 4 has a bottom plate 4*b* threadedly engaged with its open bottom. The bottom plate 4*b* has a rod-like projection $4b_1$ standing upright thereon for limiting the rearward movement of the movable bottom piece 4*a*. Also, the bottom plate 4*b* has air holes $4b_2$ made therein for expediting the displacement of the movable piece 4*a* when exposed to the negative pressure in the valve compartment 5*f* (see FIGS. 4 and 5).

The valve mechanism 5 is installed in the inner sleeve 7, and hence the container body 1. In addition to the movable nozzle 5*a* whose opposite ends are movably fitted both in the application member 2 and the sleeve 7 the valve mechanism 5 includes a movable valve 5*b*, a piston 5*c* operatively connected to the movable nozzle 5*a* via the movable valve 5*b*, an energizing means such as spring 5*d* for biasing the piston 5*c* in one direction, and a cylinder 5*e* spaced a predetermined distance from the piston 5*c* in confronting relation (see FIGS. 3, 4 and 5). Thus, an air-tight valve compartment 5*f* is delimited by the cylinder 5*e* and the piston 5*c*.

Figure 3:
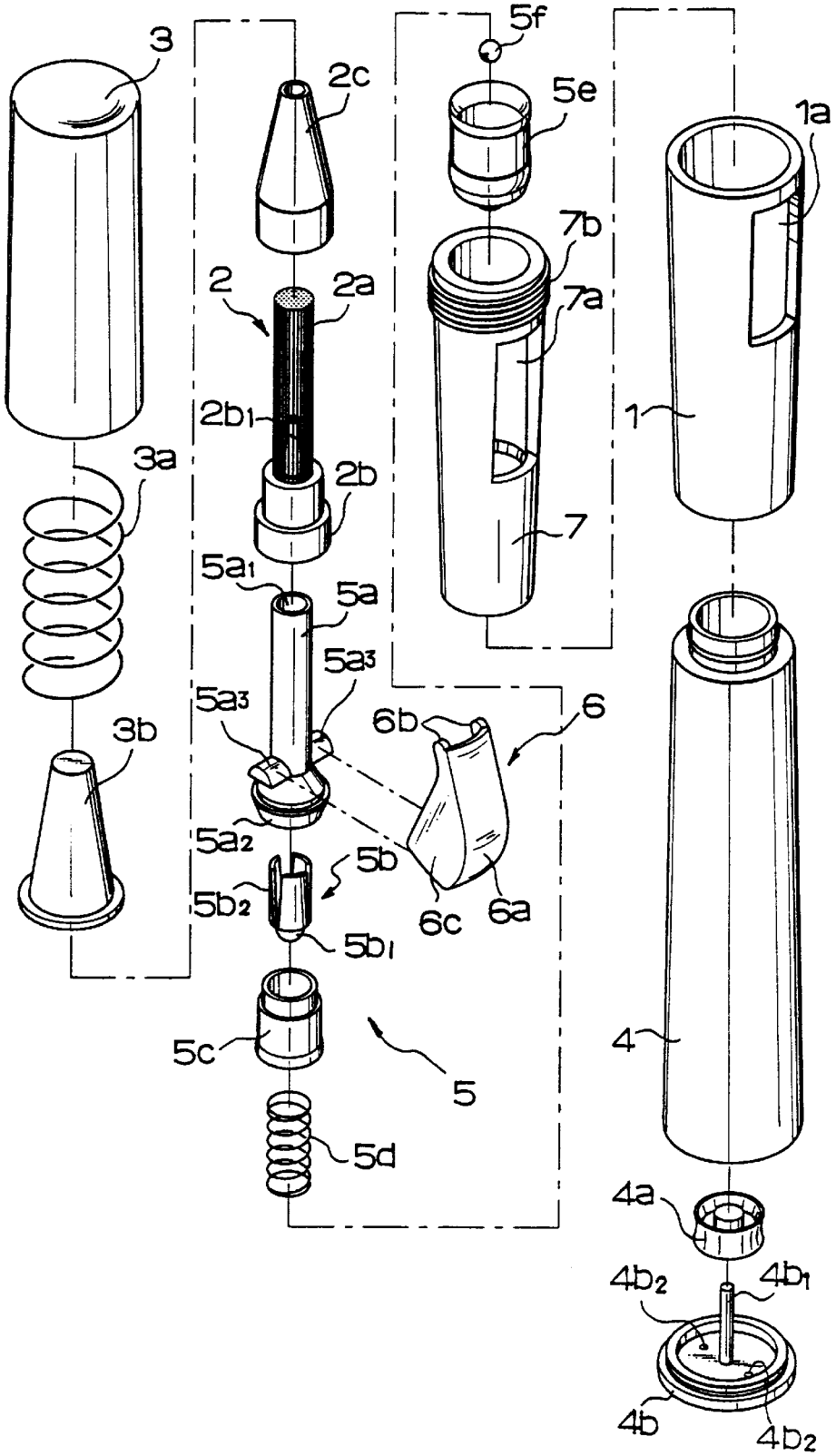
FIG. 3 is an exploded view of the side-push type of container.
Figure 6A:
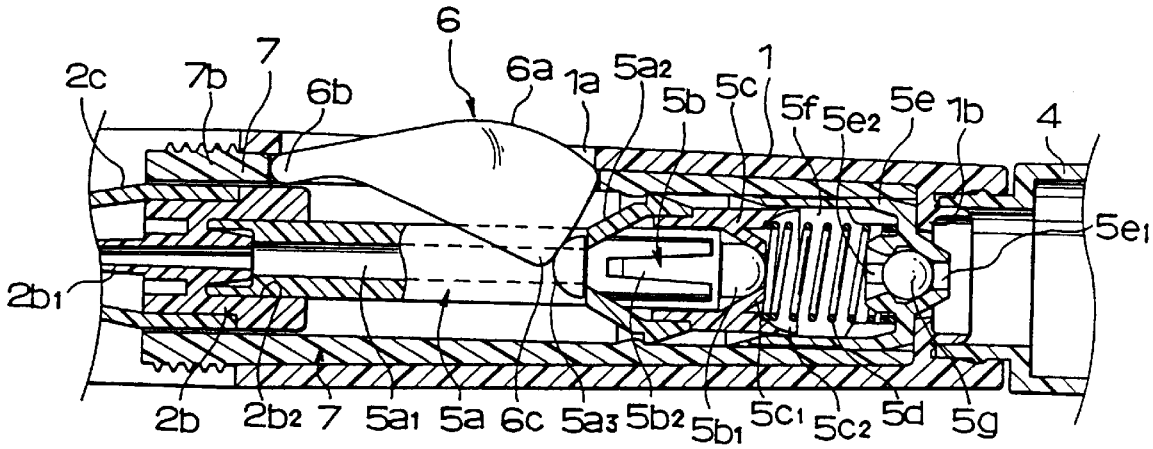
FIG. 6(*a*) is an enlarged longitudinal section of a fragment of the side-push type of container, showing the depressible button and the valve mechanism whereas FIG. 6(*b*) is a similar view, but showing how the parts work when the depressible button is depressed.
Figure 6B:
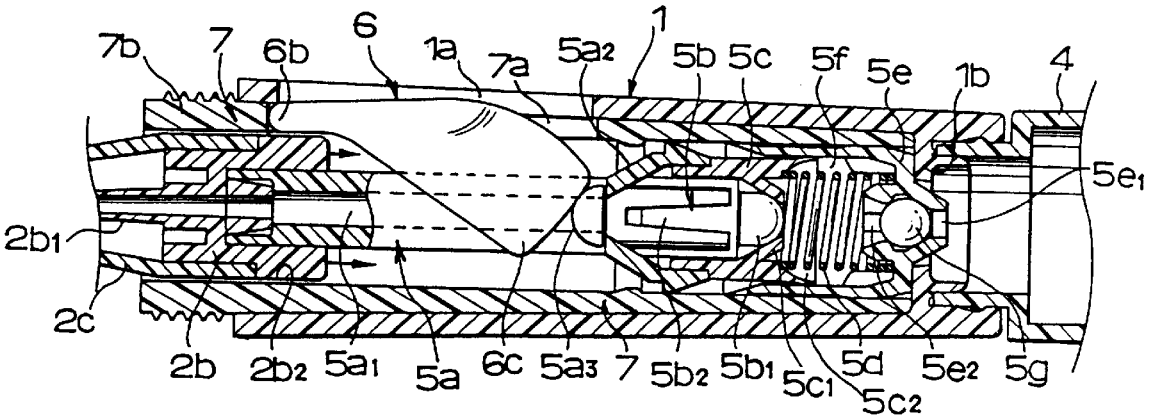

As seen from FIGS. 3 and 6, the movable nozzle 5*a* has an axial channel $5a_1$ formed along its center axis, a cup-like bulge $5a_2$ communicating with the axial channel $5a_1$ and a lateral engagement projection $5a_3$ formed in the vicinity of the cup-like bulge $5a_2$ for supporting the depressible button 6 rotatably about its pivotal end 6*b*. The so constructed movable nozzle 5*a* is press-fitted in the rear recess $2b_2$ of the brush holder 2*b*, allowing the cup-like bulge $5a_2$ to be retained in the sleeve 7.

The movable valve 5*b* comprises a semi-spherical valve body $5b_1$ and a plurality of vanes $5b_2$ integrally connected to the semi-spherical valve body $5b_1$. The vanes $5b_2$ are put in the cup-like bulge $5a_2$ of the movable nozzle 5*a* whereas the semi-spherical valve body $5b_1$ is put in the convergent throttle $5c_1$ of the piston 5*c*.

The piston 5*c* is connected to the cup-like bulge $5a_2$ of the movable nozzle 5*a* on its front side in an air-tight fashion, and to the cylinder 5*e* on its rear side in an air-tight fashion, too.

The convergent throttle $5c_1$ of the piston 5*c* converges toward the cartridge 4 on the side of upper stream, and the movable valve 5*b* is displaced toward the down stream side by yieldingly bending the vanes $5b_2$ inward to allow the cosmetic liquid material to flow in the movable nozzle 5*a*.

The coiled spring 5*d* is put in the cup-like concave 5$c_2$ of the piston 5*c*, abutting against the bottom of the cylinder 5*e* on its rear end.

The cylinder 5*e* is made of a synthetic resin and any other appropriate material, and the piston 5*c* is fitted in the cylinder 5*e* to define a valve compartment 5*f* therebetween.

The cylinder 5*e* is fitted in the sleeve 7, staying on the intermediate shelf 1*b* of the container body 1 with its valve aperture 5$e_1$ opening at the rear open end of the sleeve 7.

The cylinder 5*e* has a check valve 5*g* on its bottom, and a plurality of grooves 5$e_2$ formed around the valve aperture 5$e_1$.

The check valve 5*g* is in the form of metal ball, and it will close the valve aperture 5$e_1$ when the valve compartment 5*f* is pressurized, and will open the valve aperture 5$e_1$ when the valve compartment 5*f* is decreased in pressure. Thus, the rate at which the cosmetic liquid material flows is controlled, and the counter flow is prevented.

As seen from FIGS. 3 and 6, the depressible button 6 has a whistle-like shape, which is composed of an outward-swelling portion 6*a*, a converging end 6*b* and an inward-projecting cam portion 6*c*. The depressible button 6 is held swingably about the converging end 6*b* with the outward-swelling portion 6*a* partly exposed from the slot 1*a* of the container body 1.

As seen from FIGS. 3 and 4, the depressible button 6 is somewhat longer than the slot 1*a*, and the converging end 6*b* of the depressible button 6 is caught by the recess which is delimited by the container body 1, the sleeve 7 and the brush holder 2*b*. Thus, the depressible button 6 is held swingably about the converging end 6*b* while being prevented from slipping off from the slot 1*a* of the container body 1. The inward-projecting cam portion 6*c* is put in contact with the lateral engagement projection 5$a_3$, so that the depressible button 6 may be spring-biased toward the depressible position, in which the outward-swelling portion 6*a* is partly exposed from the container body 1. Thus, the depressible button 6 can be depressed by pushing the outward-swelling portion 6*a*, and can be allowed to return automatically to the depressible position when removing the forefinger from the depressible button 6.

The sleeve 7 is made of a synthetic resin or any other appropriate material, and it converges somewhat rearward so that the application member 2 may movably fitted in the front end of relatively large size, and that the valve mechanism 5 may be press-fitted in the rear end of relatively small size.

The so constructed side-push container can be held by single hand like a pencil to apply varnish to nails simply by pushing and releasing the depressible button, thus making it unnecessary to change hands or insert the applicator rod in the reservoir for wetting the brush with varnish every time varnish is applied to nails one after another.

Specifically the so constructed side-push type of container is held by single hand like a pencil, and the brush can be wetted with varnish simply by pushing the depressible button with the forefinger of the same hand. The depressible button 6 is pushed down to cause the inward-projecting cam portion 6*c* to push back the lateral engagement projection 5$a_3$ against the spring 5*d*, thereby moving backward the movable nozzle 5*a* and the piston 5*c* to increase the inner pressure of the valve compartment 5*f* (see FIG. 6*b*).

Then, the depressible button 6 is released to allow it to rise, and at the same time, the movable nozzle 5*a* and the piston 5*c* return to their initial positions to cause a negative pressure in the valve compartment 5*f*, thus moving the movable bottom piece 4*a* forward to draw a fixed amount of varnish from the cartridge 4 to the application member 2 through the valve opening 5$e_1$, the grooves 5$e_2$ and the valve compartment 5*f*.

FIGS. 7 to 12 show a side-push type of container B according to the second embodiment of the present invention. The same parts as in the first embodiment are indicated by the same reference numerals as used in FIGS. 1 to 6, and only the parts which are not used in the first embodiment are indicated by new reference numerals.

Figure 7:
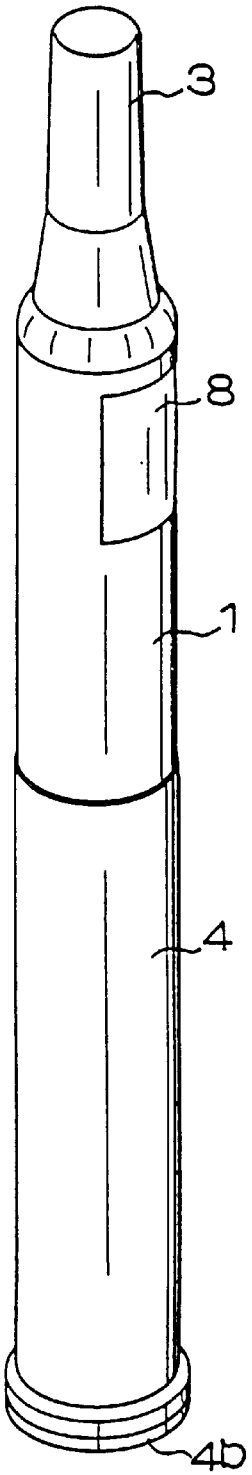
FIG. 7 is a perspective view of a side-push type of container according to a second embodiment of the present invention.
Figure 8:
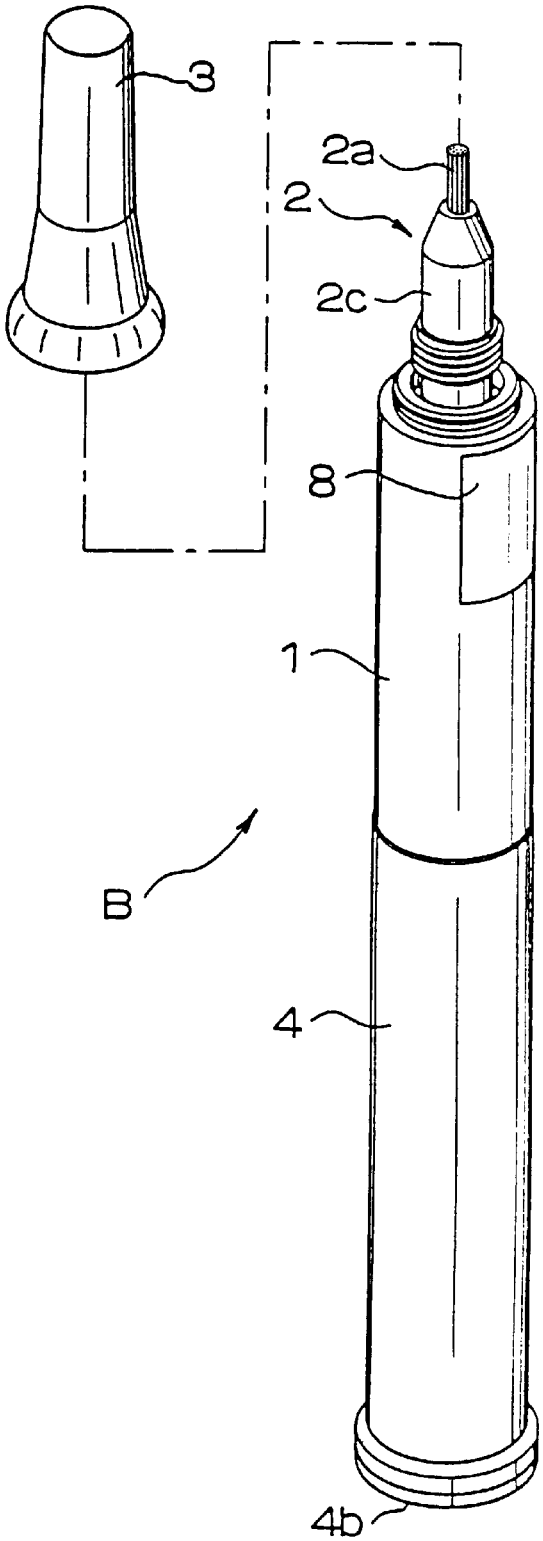
FIG. 8 is a perspective view of the side-push type of container with its cap removed from its container body.
Figure 9:
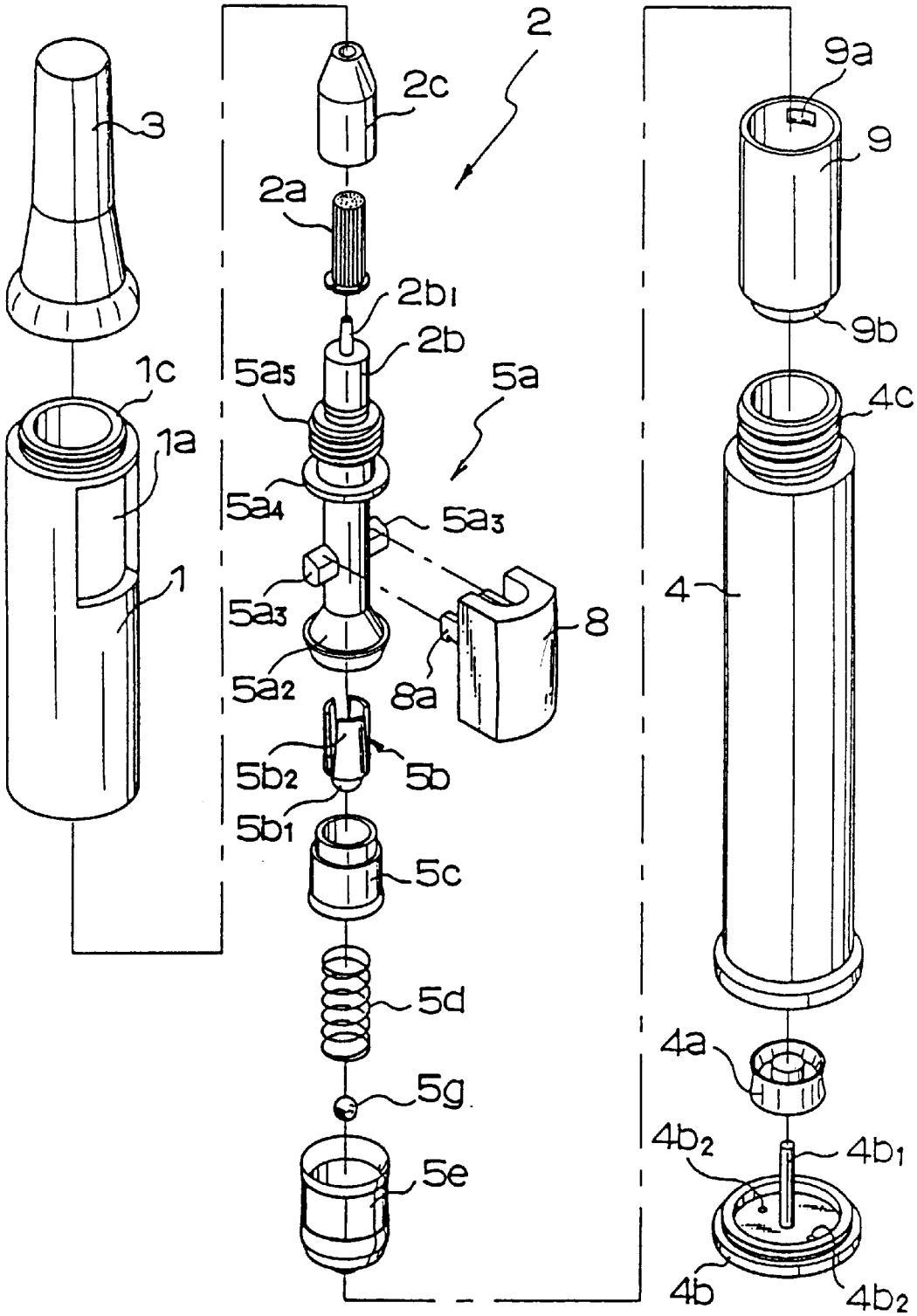
FIG. 9 is an exploded view of the side-push type of container.

FIG. 7 is a perspective view of the side-push type of container B, and as shown, the container B has a depressible button 8 flush with its outer surface.

As seen from FIGS. 9 to 12, the depressible button 8 has a cam piece 8*a* integrally connected thereto. The cam piece 8*a* has two parallel tapering extensions 8*a* each ending with a hook-like shape 8*b*. The depressible button 8 is engaged with the movable nozzle 5*a* by allowing the hook ends 8*b* of the cam piece 8*a* to be caught by the lateral engagement piece 5$a_3$ of the movable nozzle 5*a*. Thus, the depressible button 8 is prevented from slipping off from the slot 1*a* of the container body 1, but is permitted to be pushed in the container body 1.

The movable nozzle 5*a* has an annular collar 5$a_4$, an annular piece 5$a_5$ and a brush holder 2*b* on the top side of the movable nozzle 5*a*. The annular collar 5$a_4$ is formed for closing the top opening of the container body 1. The annular piece 5$a_5$ has threads formed therearound for threadedly engaging with the tapped cap 3, and the brush holder 2*b* holds the brush 2*a*.

The sleeve 9 is a relatively short cylinder of a synthetic resin, and it has two confronting projections 9*a*, 9*a* formed on its inner surface. These projections 9*a*, 9*a* are put in contact with the cup-like expansion 5$a_2$ of the movable nozzle 5*a*, thereby preventing the slipping-off of the movable nozzle 5*a* from the top opening of the container body 1.

Figure 12A:
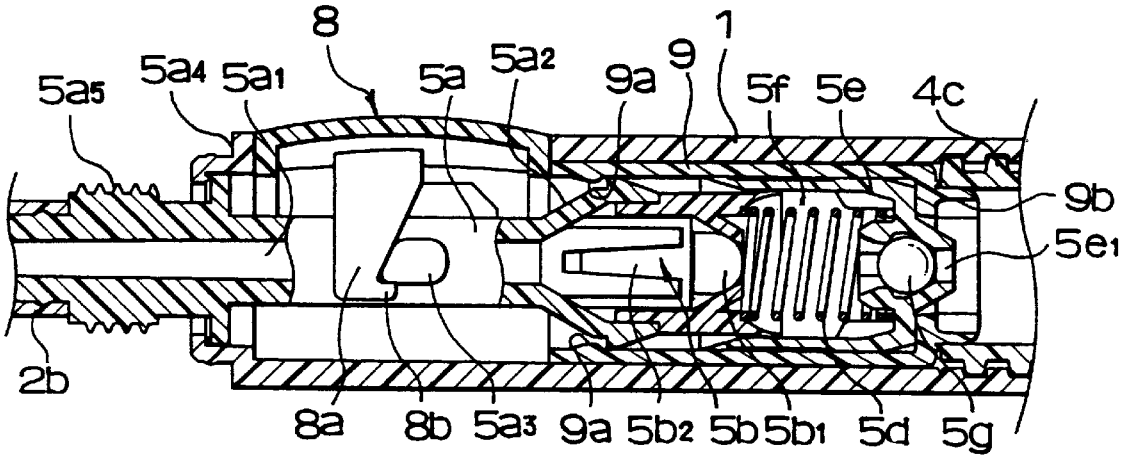
FIG. 12(*a*) is an enlarged longitudinal section of a fragment of the side-push type of container, showing the depressible button and the valve mechanism whereas FIG. 12(*b*) is a similar view, but showing how the parts work when the depressible button is depressed; an FIG. 13 is a longitudinal section of a conventional varnish applicaton.
Figure 12B:
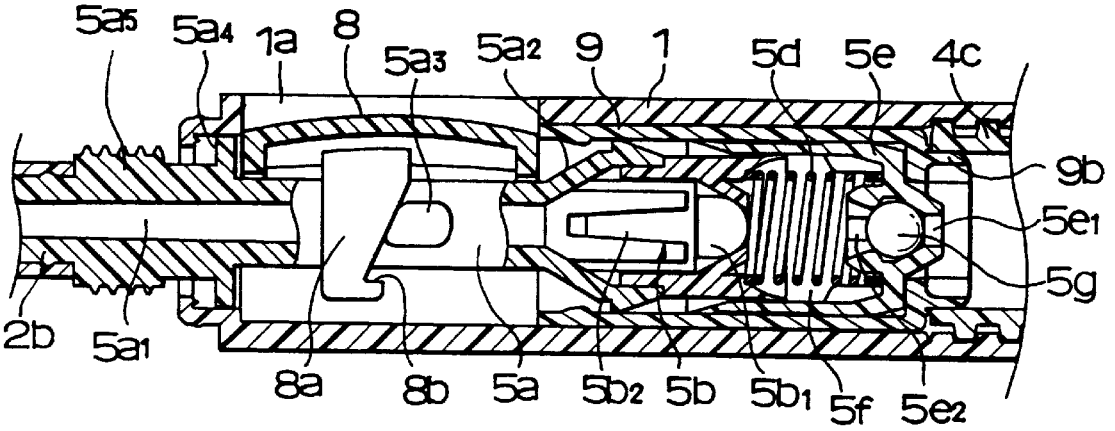
Figure 13:
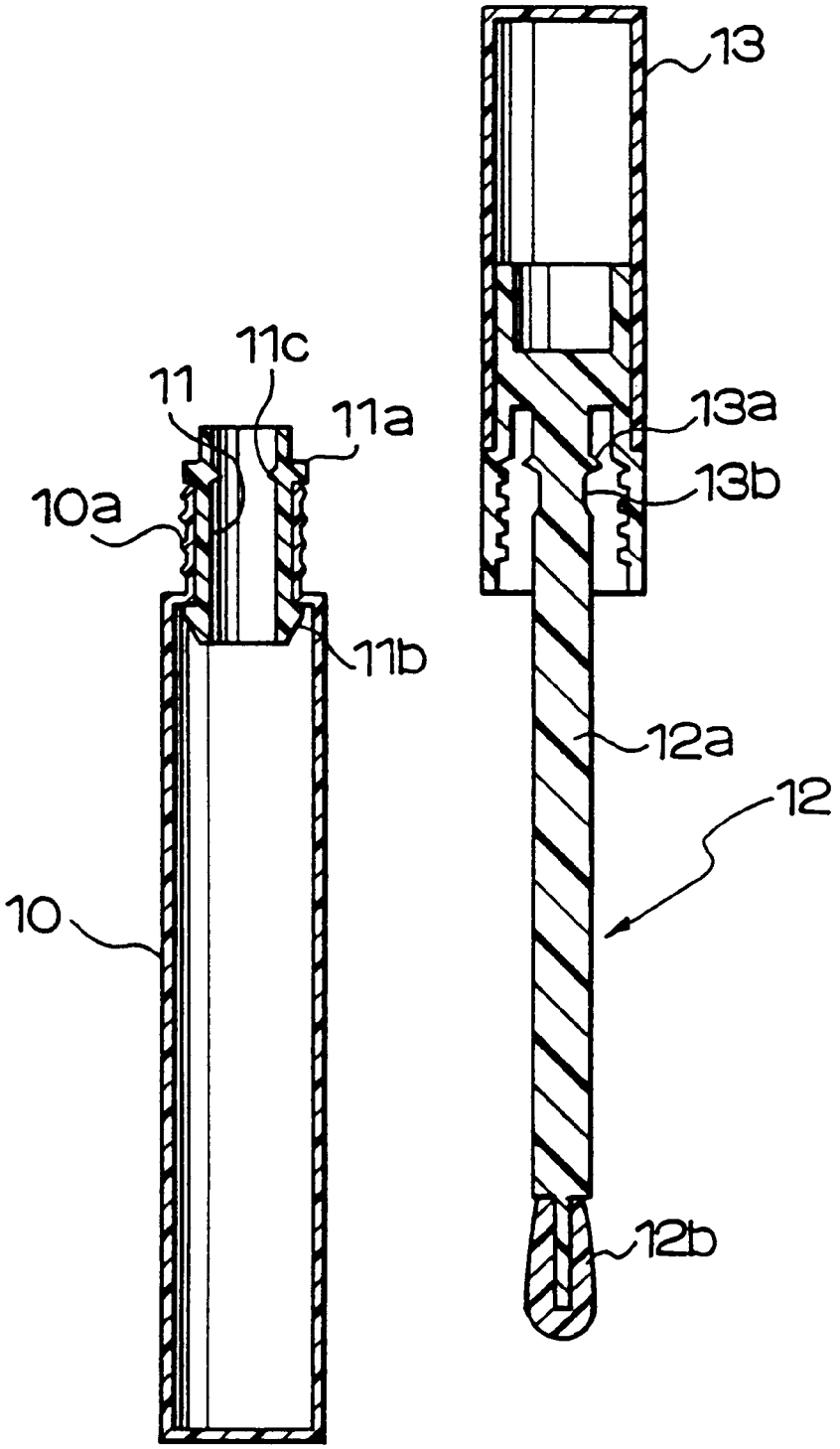
FIG. 13 PRIOR ART

The valve mechanism 5 is installed in the sleeve 9, resting on the bottom end of the container body 1, and the threaded projection 4*c* of a cartridge body 4 is threadedly engaged with the tapped bottom opening of the container body 1 so that the bottom annular projection 9*b* of the sleeve 9 is press-fitted in the top opening of the cartridge body 4 to permit the cartridge 4 to communicate with the valve mechanism 5 in air-tight fashion, as seen in FIGS. 12*a* and 12*b*.

Figure 10:
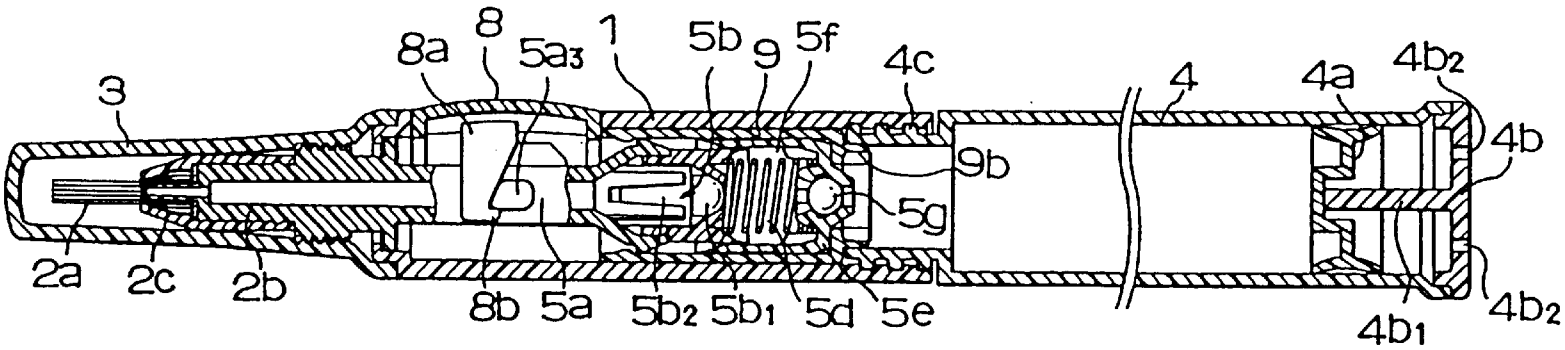
FIG. 10 is a longitudinal section of the side-push type of container.
Figure 11:
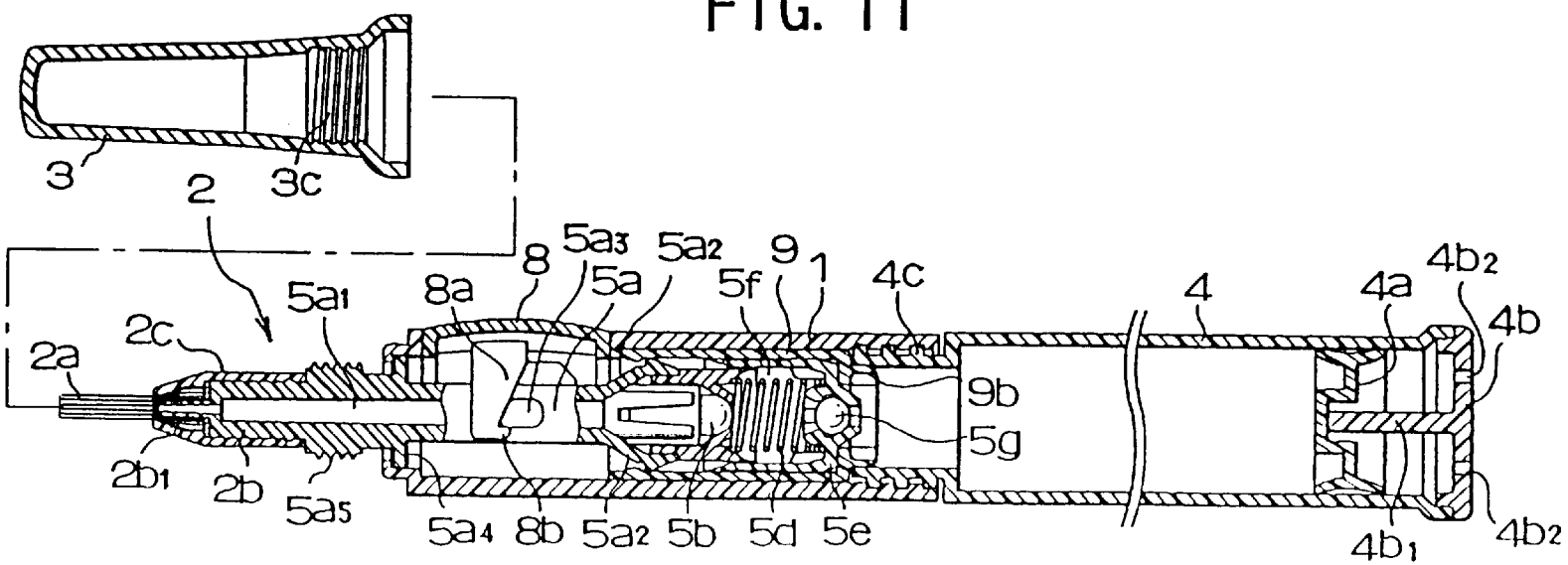
FIG. 11 is a longitudinal section of the side-push type of container with its cap removed from its container body.

When the cap 3 is put on the application member 2, and when it is rotated to be threadedly engaged with the annular piece 5$a_5$ of the movable nozzle 5*a*, the movable nozzle 5*a* is locked to be prevented from moving (see FIG. 10). Then, the depressible button 8 cannot be pushed in the container body 1, thereby preventing undesired leakage of varnish when the varnish applicator is not used.

In other words, the side-push type of container B has the movable nozzle 5*a* put in movable condition relative to the container body 1 when the cap 3 is removed (see FIG. 11), thus permitting the pushing-in of the depressible button 8. When the depressible button 8 is pushed in the container body 1 by the forefinger of the hand while holding the container B in the same hand, the lateral engagement piece 5$a_3$ of the movable nozzle 5*a* is pushed back against the spring 5*d* to move the movable nozzle 5*a* and the piston 5*c* backward, thereby increasing the inner pressure of the valve compartment 5*f* (FIG. 12*b*).

Then, the depressible button 8 is released by removing the forefinger therefrom to allow the depressible button 8 to rise in the influence of spring 5*d*, thus allowing the movable nozzle 5*a* and the piston 5*c* to return to their original positions. In response to a negative pressure thus caused, the movable bottom plate 4*a* is allowed to move forward in the cartridge body 4 to drive a predetermined amount of cosmetic liquid material up to the application member 2 via the valve aperture $\mathbf{5}e_1$, the grooves $\mathbf{5}e_2$, the valve compartment 5*f*, the movable valve 5*b* now pushed up, the movable nozzle 5*a* and the ejection nozzle $\mathbf{2}b_1$.

The side-push type of containers as described above can be modified without departing the spirit of the present invention, as for instance follows: the cartridge body may be integrally connected to the container body.

A side-push type of container according to the present invention is described above as containing varnish. It may contain other cosmetic liquid materials such as mascara, foundation cream. Toothpaste, shoe polish and other liquid, gel, powder material may be equally contained.

What is claimed is:

1. A side-push type container comprising:

a reservoir that stores a liquid material;

a hollow container body connected to the reservoir and having a depressible push button on a side of the hollow container body;

an application member partly inserted into the hollow container body, thereby exposing a remaining part of the application member from the hollow container body; and a valve mechanism comprising a movable nozzle having a first end and a second end having a lateral engagement portion extending transverse to a central axis of the movable nozzle, a piston having a forward end connected to the second end of the movable nozzle via a movable valve, energizing means for biasing the piston in a direction coaxial with the central axis of the movable member, and a cylinder that delimits a leak-tight valve compartment with the piston, the leak-tight valve compartment communicating with the reservoir and housing at least the energizing means such that the valve mechanism feeds a fixed amount of the liquid material to the application member when the lateral engagement portion engages the energizing means in response to depression of the depressible push button.

2. A side-push type of container according to claim 1 wherein the first end of the movable nozzle is slidably fitted in the application member and the second end of the movable nozzle is slidably fitted into the hollow container, the cylinder being spaced a predetermined distance from the piston in confronting relation when the energizing means is not engaged by the lateral engagement portion and the container further comprises a movable bottom piece fitted in the reservoir in leak-tight fashion.

3. A side-push type container according to claim 2 wherein the first end of the movable nozzle further comprises an annular collar to close a top opening of the hollow container body.

4. A side-push type of container according to claim 2 wherein the movable bottom piece has a concave circumference in double-linear contact with an inner wall of the reservoir.

5. A side-push type of container according to claim 2 wherein the movable nozzle further comprises an axial channel formed along the central axis and a cup-like bulge portion formed at the second end of the movable nozzle that communicates with the axial channel, the lateral engagement portion engaging at least one part of the depressible push button.

6. A side-push type of container according to claim 5 wherein the depressible push button has at least one cam piece protruding toward the movable nozzle transverse to the central axis of the movable nozzle, each of said at least one cam piece having a hook end portion that is engaged by the lateral engagement portion of the movable nozzle when the depressible push button is depressed.

7. A side-push type of container according to claim 1 wherein the reservoir is detachably attached to the hollow container body.

* * * * *